US007632037B2

(12) United States Patent
Brinkman

(10) Patent No.: US 7,632,037 B2
(45) Date of Patent: Dec. 15, 2009

(54) DOWEL APPARATUS AND METHOD

(75) Inventor: Mark Brinkman, St. Louis Park, MN (US)

(73) Assignee: Construction Materials, Inc., St. Louis Park, MN (US)

( * ) Notice: Subject to any disclaimer, the term of this patent is extended or adjusted under 35 U.S.C. 154(b) by 570 days.

(21) Appl. No.: 10/912,521

(22) Filed: Aug. 5, 2004

(65) Prior Publication Data

US 2005/0232697 A1 Oct. 20, 2005

(51) Int. Cl.
*E01C 11/14* (2006.01)

(52) U.S. Cl. ..... 404/60; 404/58; 404/59; 404/62

(58) Field of Classification Search ..... 29/417; 404/51–63

See application file for complete search history.

(56) References Cited

U.S. PATENT DOCUMENTS 2,095,060 A * 10/1937 Geyer ..... 404/60
2,508,443 A * 5/1950 Carter ..... 404/60
3,397,626 A 8/1968 Kornick et al.
5,216,862 A * 6/1993 Shaw et al. ..... 52/396.02
5,797,231 A * 8/1998 Kramer ..... 52/396.02
5,934,821 A * 8/1999 Shaw et al. ..... 404/62
6,471,441 B1 * 10/2002 Muller ..... 404/62
6,517,277 B2 * 2/2003 Hu et al. ..... 403/294
6,598,364 B1 * 7/2003 Pelles ..... 52/396.02
2003/0186035 A1 * 10/2003 Cruce et al. ..... 428/292.4
2004/0016200 A1 * 1/2004 Fyfe ..... 52/698

* cited by examiner

*Primary Examiner*—Raymond W Addie
(74) *Attorney, Agent, or Firm*—Schwegman, Lundberg & Woessner, P.A.

(57) ABSTRACT

A dowel includes a corrosion-resistant sleeve, and a rod positioned within the sleeve. A sealant connects the corrosion-resistant sleeve and the rod. A method for constructing a dowel includes positioning a rod within a corrosion-resistant sleeve, and sealing the rod with respect to the corrosion-resistant sleeve.

32 Claims, 5 Drawing Sheets

DOWEL APPARATUS AND METHOD

FIELD OF THE INVENTION

The present invention is related to a dowel used for joining and reinforcing concrete slabs.

BACKGROUND

Concrete is often the preferred material for roadway slabs because it tends to be relatively strong, durable and cost-effective over the life of a roadway or highway. Moreover, a well-designed and well-constructed concrete roadway may be less susceptible to potholes and the need for resurfacing than a comparable asphalt roadway. As a result, major highway systems and other major roadways are constructed of concrete.

A typical method of constructing roadways and highways involves preparing a base that includes a course of crushed rock or other material. A network of reinforcing bar is placed over the crushed rock. The continuous slab of concrete is poured over the reinforcing bar over the base of crushed rock. The continuous slab may be sprayed with a substance that slows the loss of moisture from the concrete. After the continuous slab of concrete is allowed to cure for a selected amount of time, the continuous slab is sawed into individual concrete slabs at a selected distance interval. Concrete cures to about 90% of its strength in about 28 days. Generally, the joints are sawed well before the concrete reaches 90% of its strength while the concrete is "green." The expansion joints are formed between the individual slabs. Expansion joints usually include gaps between adjacent concrete slabs filled with resilient materials, such as an elastomeric caulk. The caulk expands and compresses in response to the thermal loads on the slabs.

The expansion joints allow the individual concrete slabs to contract in cold conditions and expand in hot conditions with less cracking or buckling in the individual concrete slab formed. In other words, separating the continuous concrete slab into individual concrete slabs reduces the number of cracks in the concrete resulting from thermal cycling of the concrete between cold conditions and hot conditions. Annual temperature variations in many areas have a range exceeding 95 degrees Fahrenheit (60 degrees Celsius).

The smaller individual concrete slabs can shift relative to one another over time. Dowels are used to join the individual slabs and prevent the shifting of slabs with respect to one another. Dowels also aid in transferring the load from one individual concrete slab onto the next individual concrete slab on a roadway. For example, as the load from a truck or car crosses a joint between two individual slabs, a set of dowels embedded into the roadway between the two slabs transfers the load from the first slab to the second slab. The dowels also prevent shifting between the slabs. The dowels reduce the effect where a car or truck feels a rhythmic bouncing or thumping at each joint as it travels down the highway.

Currently, the dowels are formed of steel. Even though the dowels are embedded in the concrete between slabs, moisture from rain or other sources reaches the dowels and the dowels corrode. Eventually, as a result of the corrosion, the dowels fail. In colder climates, salt is spread on the roadway to lessen the amount of ice on the roadway. Salt lowers the melting point of water so that ice, if formed, must be at a much lower temperature. The salt used on the roadways speeds the corrosion of the dowels, and shortens the life of the dowels. Once the dowels fail, the concrete roadway is much more prone to misalignment between individual slabs. In addition, the individual slabs may also crack and fail in other ways after a dowel or set of dowels fail.

SUMMARY OF THE INVENTION

A dowel includes a corrosion-resistant sleeve, and a rod positioned within the sleeve. A sealant connects the corrosion-resistant sleeve and the rod.

In one embodiment of the invention, the corrosion-resistant sleeve is a stainless steel sleeve and the rod positioned within the corrosion-resistant sleeve is a steel rod.

The steel rod includes a first end and a second end. The corrosion-resistant sleeve also includes a first end and a second end. The first end of the corrosion-resistant sleeve and the second end of the corrosion-resistant sleeve are sealed to prevent exposure of the first end of the rod within the corrosion-resistant sleeve and the second end of the rod within the corrosion-resistant sleeve. In some embodiments, the sealant includes silicone. In other embodiments, the sealant includes an adhesive.

A dowel system includes a dowel and a spacer assembly associated with the dowel. The dowel includes a corrosion-resistant sleeve, a rod positioned within the corrosion-resistant sleeve, and a sealant for substantially sealing the rod within the corrosion-resistant sleeve. In some embodiments, the sealant also bonds the rod within the corrosion-resistant sleeve. The spacer assembly includes at least one spacer attached to the dowel. In some embodiments, the least one spacer is attached to the corrosion-resistant sleeve. The spacer assembly is adapted to hold the dowel a selected distance from a surface. Other embodiments of the dowel system include a plurality of dowels. The spacer assembly is adapted to hold the plurality of dowels at a selected distance from a surface.

A roadway includes a first slab of material, and a second slab of material. The roadway also includes at least one dowel having a first end engaged with a first slab of material and a second end engaged with a second slab of material. The at least one dowel further includes a corrosion-resistant sleeve, a rod positioned within the corrosion-resistant sleeve, and a sealant for substantially sealing the rod within the corrosion-resistant sleeve. The roadway also includes a spacer assembly associated with the at least one dowel. The roadway further includes a base of crushed material. The first slab of material and the second slab of material are positioned adjacent the base of crushed material. The spacer assembly associated with the at least one dowel spaces the dowel a selected distance from the base of crushed material. In some embodiments, the first end of the dowel is slidably engaged with the first slab and the second end of the dowel is slidably engaged with the second slab. In some embodiments, the first slab of material and the second slab of material include cement and aggregate.

A method for constructing a dowel includes positioning a rod within a corrosion-resistant sleeve, and sealing the rod with respect to the corrosion-resistant sleeve. Sealing the rod with respect to the corrosion-resistant sleeve includes placing a sealant on the outer surface of the rod. In some embodiments, the rod is substantially cylindrically shaped. Sealing the rod with respect to the corrosion-resistant sleeve includes placing a sealant on the cylindrical surface of the rod. The method further includes rotating the rod. In some embodiments, the rod is rotated while it is positioned within the corrosion-resistant sleeve. In other embodiments, the rod is rotated after it is positioned within the corrosion-resistant sleeve. Sealing the rod with respect to the corrosion-resistant sleeve, in some embodiments, includes placing a sealant over a first end of the rod and a second end of the rod.

BRIEF DESCRIPTION OF THE DRAWINGS

The invention is pointed out with particularity in the appended claims. However, a more complete understanding of the present invention may be derived by referring to the detailed description when considered in connection with the figures, wherein like reference numbers refer to similar items throughout the figures, and:

The description set out herein illustrates the various embodiments of the invention, and such description is not intended to be construed as limiting in any manner.

DETAILED DESCRIPTION

In the following detailed description of the preferred embodiments, reference is made to the accompanying drawings that form a part hereof, and in which are shown by way of illustration specific embodiments in which the invention can be practiced. The embodiments illustrated are described in sufficient detail to enable those skilled in the art to practice the teachings disclosed herein. Other embodiments can be utilized and derived therefrom, such that structural and logical substitutions and changes can be made without departing from the scope of present inventions. The following detailed description, therefore, is not to be taken in a limiting sense, and the scope of various embodiments of the invention is defined only by the appended claims, along with the full range of equivalents to which such claims are entitled.

Figure 1:
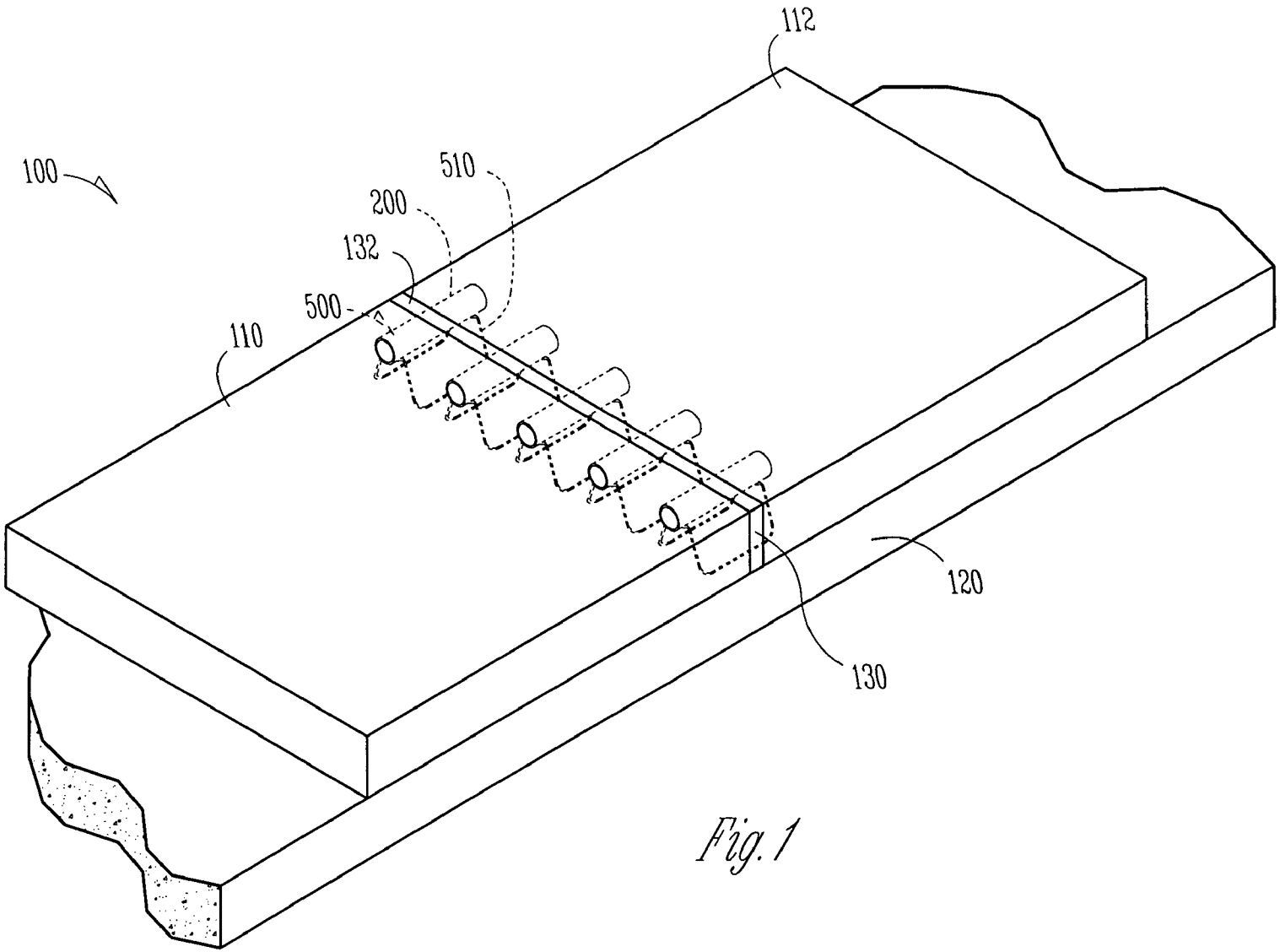
FIG. 1 is perspective view of a roadway, according to an embodiment of this invention.

FIG. 1 is perspective view of a roadway 100, according to an embodiment of this invention.

The roadway 100 includes a first slab of material 110 and a second slab of material 112 that rests on a bed of crushed material 120. Encapsulated within the slab of material 110 and the slab of material 112 is at least one dowel 200. The dowel 200 is part of a dowel assembly 500. The dowel assembly 500 includes the dowel 200 and a spacing assembly 510. The dowel 200 and the dowel assembly 500 are shown in phantom in FIG. 1 since the dowel 200 and dowel assembly 500 are encapsulated within the slabs of material 110 and 112. As shown in FIG. 1, there are a plurality of dowel assemblies 500. Each dowel assembly 500 includes a dowel 200 and a spacing assembly 510. A joint 130 is formed between the slabs of material 110 and 112. The joint 130 is filled with an elastomeric material 132 which substantially seals the top surface of the roadway, which is exposed to the elements, from the portions of the roadway at or near the joint 130. The dowel assemblies 500 are positioned on either side of the joint 130. Each dowel 200 includes one end which extends into the slab of material 110 and another and that extends into the slab of material 112. In one embodiment of the invention, the slabs of material 110 and 112 are made of concrete which includes cement and aggregate. The dowels 200 provide a slidable connection between the first slab of material 110 and the second slab of material 112. The dowels 200 also transfer the load from the first slab of material 110 to the second slab of material 112 when a vehicle passes along the roadway 100. The dowels prevent shifting between the slabs of material 110 and 112. The joint 130 and more specifically, the elastomeric material 132 within the joint are generally termed an expansion joint. The expansion joint accommodates expansion and contraction of the slab of material 110 and the slab of material 112 through the various temperature conditions associated with an environment where the roadway 100 is placed. Many roadways 100 are exposed to environmental conditions which have a thermal range exceeding 95 degrees Fahrenheit. In some of the northern climates the thermal range exceeds 120 degrees Fahrenheit. The elastomeric material 132 within the joint 130 seals the dowel assemblies 500 and specifically the dowels 200 from much of the environment that the roadway is exposed to. However, moisture, such as precipitation, will generally result in at least some portion contacting the dowel or plurality of dowels 200. It should be noted that the dowel assemblies 500 and the dowels 200 are generally positioned along the joint 130.

Figures 2, 3, 4:
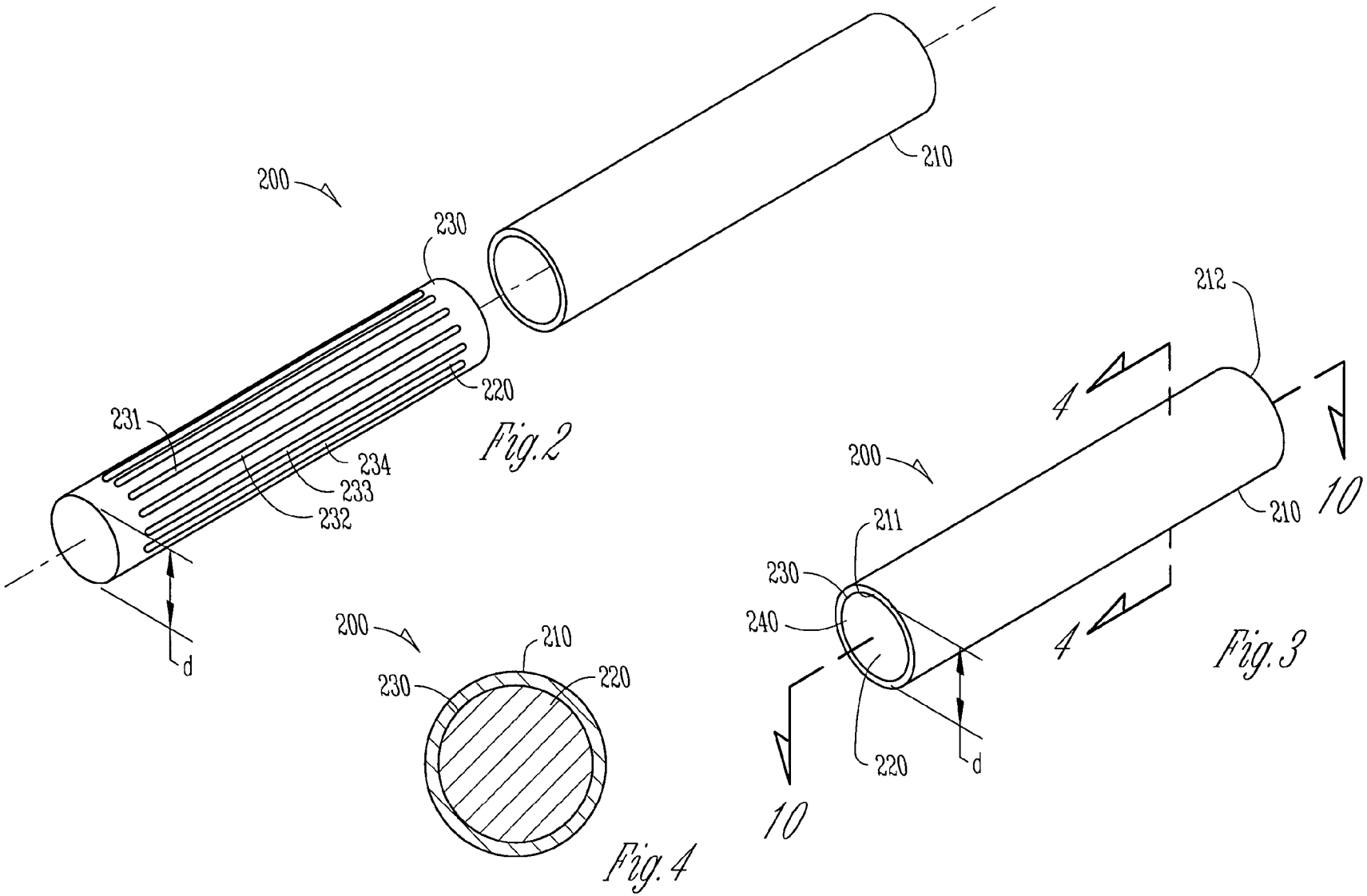
FIG. 2 is an exploded perspective view of dowel, according to an embodiment of this invention.
FIG. 3 is perspective view of an assembled dowel, according to an embodiment of this invention.
FIG. 4 is a cross-sectional view of the dowel along line 4-4 in FIG. 3, according to an embodiment of this invention.

FIG. 2 is a perspective view of a dowel 200 according to an embodiment of this invention. The dowel 200 includes a corrosion-resistant or non-corrosive sleeve 210 and a rod 220 positioned within the corrosion-resistant sleeve 210. The rod 220 can also be termed a core. The rod or core 220 has a diameter that is slightly smaller than the inner diameter of the corrosion-resistant sleeve 210. The corrosion-resistant sleeve 210 can be made of any non-corrosive or corrosion-resistant material such as plastic, fiberglass or stainless steel. In one embodiment of the invention, the corrosion-resistant sleeve 210 is made of a grade 316L-A269 type of stainless steel as defined by the American Society for Testing and Materials (ASTM). A sealant is used to connect the corrosion-resistant sleeve 210 and the rod or core 220. As shown in FIG. 2, a sealant 230 is formed as beads or stripes of sealant. For example, the beads or stripes of sealant include reference numerals 231, 232, 233 and 234. The sealant also acts as an adhesive or has an adhesive quality in that the stripes of sealant and adhesive 230, 231, 232, 233 and 234 can be used to attach as well as seal the rod or core 200 within the corrosion-resistant or non-corrosive sleeve 210. As shown in FIG. 2, the adhesive and sealant 230 is placed onto the outside surface or the cylindrical surface of the core or rod 220 as a set of parallel stripes. After insertion of the rod or core 220 into the corrosion-resistant or non-corrosive sleeve 210, the sealant and adhesive 230 is substantially uniformly distributed about the periphery or about the cylindrical surface of the rod or core 220. This is accomplished by twisting the rod or core 220 during insertion of the rod or core 220 into the inner diameter of the corrosion-resistant or non-corrosive sleeve 210.

FIG. 3 is a perspective view of an assembled dowel 200 according to an embodiment of this invention. The assembled dowel 200 has the core 220 extended or positioned within the inner diameter of the corrosion-resistant or non-corrosive sleeve 210. A sealant and adhesive material 230 substantially seals the core 220 from the corrosion-resistant sleeve 210. In addition to the adhesive and sealant material 230 on the cylindrical or cylindrical surface of the core or rod 220, an end cap 240 of a sealant or an adhesive and sealant material is placed over the end of the rod or core 220 to further seal the rod 220 within the corrosion-resistant or non-corrosive sleeve 210. The rod 220 has two ends 211 and 212. The end cap 240 of the adhesive and sealant material is associated with the end 211 of the sleeve. A similar end cap of adhesive and sealant material is also formed at the other end 212 of the corrosion-resistant or non-corrosive sleeve 210 of the dowel 200. Therefore, each end 211 and 212 of the corrosion-resistant sleeve 210 includes an end cap such as end cap 240 which substantially seals the ends of the rod or core 220. The end result is that the core or rod 220 is substantially sealed with respect to the corrosion-resistant or non-corrosive sleeve 210. The rod or core 220 can be a strong, less expensive material such as steel. A steel rod or core 220 will corrode if exposed to environmental conditions such as moisture. Corrosion of steel takes place at a faster rate in the presence of salt and water. By substantially sealing the rod or core 220 with respect to the corrosion-resistant sleeve 210, the rod or core 220 is provided with a protective overcoat of non-corrosive or corrosion-resistant material. This covering prevents or substantially inhibits the rate of corrosion of the core or rod 220 within the corrosion-resistant sleeve 210.

FIG. 4 is a cross-sectional view of the dowel 200 along line 4-4 in FIG. 3 according to an embodiment of this invention. As shown in FIG. 4, a rod 220 of a first material is connected or sealed with respect to a sleeve of corrosion-resistant or non-corrosive sleeve 210 by a layer of an adhesive and sealant material 230. As shown in FIG. 4, the adhesive and sealant material 230 is substantially uniformly distributed about the periphery of the rod or core 220. It should be noted that in some embodiments of the invention, there may be portions of the cylindrical surface or outer surface of the rod 220 which are not completely covered by the adhesive and sealant material 230. As shown in FIG. 2, the outer sleeve or the outer corrosion-resistant or non-corrosive sleeve 210 is formed of a metal material. As mentioned previously, it is contemplated that the outer sleeve need not be made of a metal but can also be made of other corrosion-resistant or non-corrosive material such as plastic, fiberglass, polyvinyl chloride or the like. When a non-steel sleeve 210 is provided, generally the diameter of the core or rod 220 will have to be enlarged with respect to the embodiment, in which a steel or metal corrosion-resistant sleeve 210 is used. The core or rod 220 will have to be enlarged in order to provide sufficient strength to transfer loads between slabs and to maintain alignment of the slabs of material 110 and 112 (as shown in FIG. 1).

Figure 5:
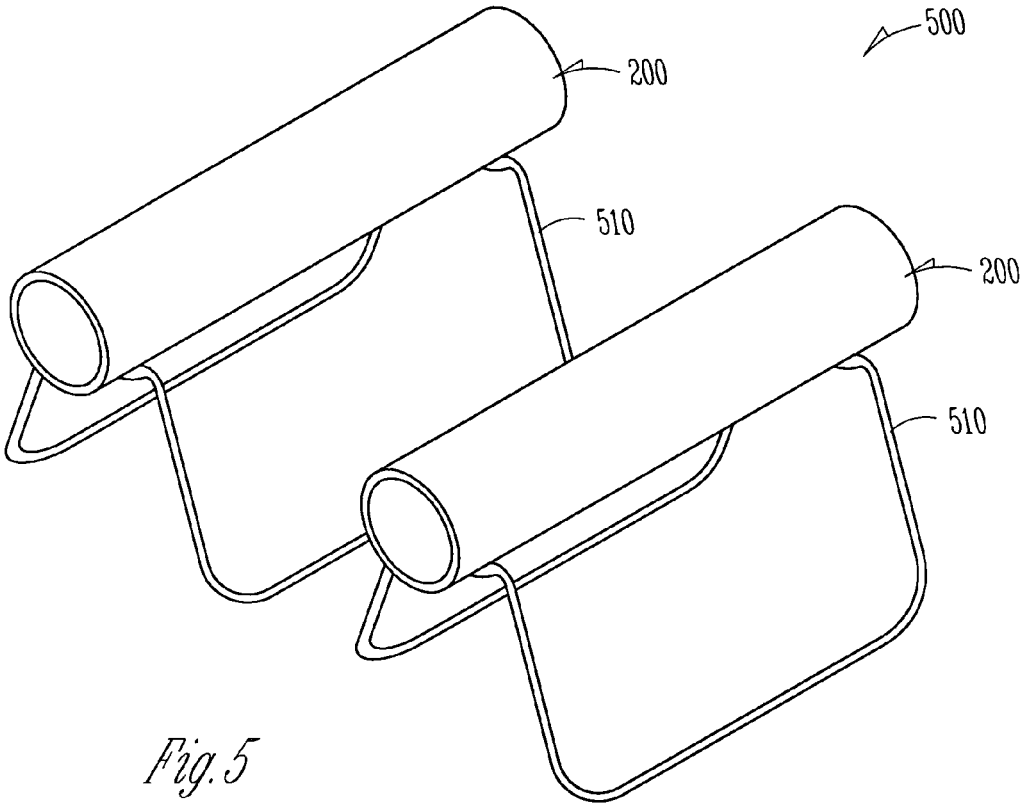
FIG. 5 is a perspective view of dowel assembly including one or more dowels, according to an embodiment of this invention.

FIG. 5 is a perspective view of a dowel assembly 500 including one or more dowels 200 according to an embodiment of this invention. As shown in FIG. 5, a dowel assembly includes a spacing assembly 510 and a dowel 200. The spacing assembly 210 is adapted to space the dowel with respect to the base bed of crushed material 120 of the roadway during the initial pouring or construction of the roadway 100. When a concrete roadway is constructed, the spacing assembly 510 is mechanically tied to other portions of reinforcing bar (not shown) which are placed inside the roadway. A constant or continuous slab of concrete is poured over the reinforcing bar and a roll of dowel assemblies 500. After the concrete sets for a selected amount of time, the joints 130 are cut within the roadway. The joints 130 are spaced so that they are positioned over the dowel 200 and over the dowel assembly 500. The joint 130 is completed since the sod portion of the joint 130 forms a weak spot in the continuously poured concrete. Generally, a crack will form that corresponds to the sod joint, thereby completing the joint 130 so that the concrete is actually a series of slabs such as the slab of material 110 and the slab of material 112. The spacing assemblies 510 can be of any type of spacing assembly. One common type of spacing assembly is called a basket which includes a heavy-duty iron wire which holds the dowel 200 off the base or bed of crushed material 120 of the roadway. A basket or spacing element can hold a single dowel 200 or a plurality of dowels. Generally, the dowels are held parallel to one another in a row that corresponds to at least a portion of the width of the first slab of material 110 and the second slab of material 112. Generally, the basket is also made of iron so that the basket can also be tied to the reinforcing bar used to reinforce the concrete used in the roadway. Concrete is very good in compression but when placed in tension, concrete tends to crack. As a result, reinforcing bars are added to the concrete to enhance its ability to withstand tension.

Figure 6:
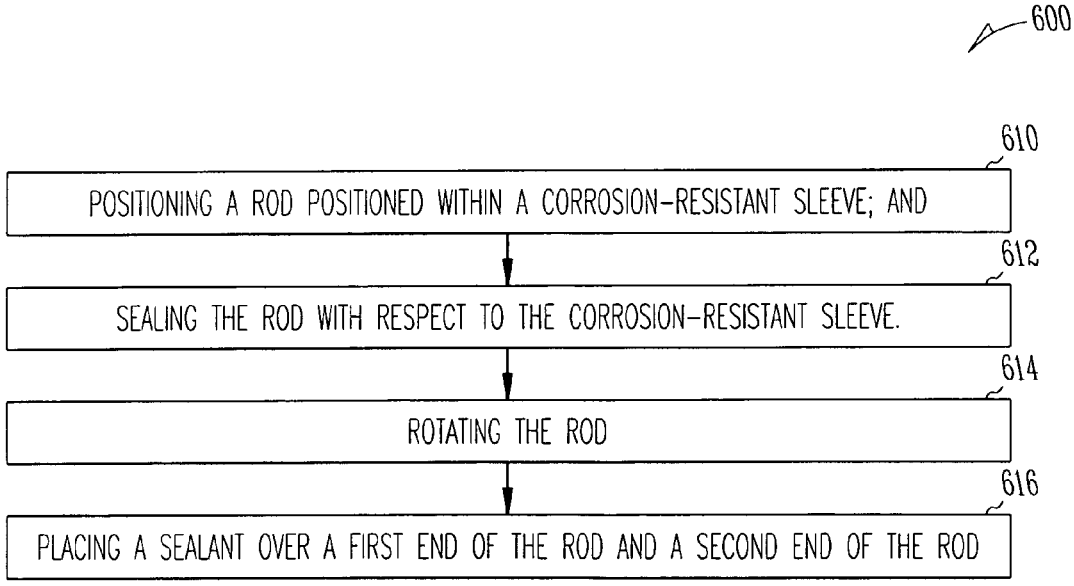
FIG. 6 is a flow diagram of a method of forming a dowel, according to an embodiment of this invention.

FIG. 6 is a flow diagram of a method 600 performing a dowel, according to an embodiment of this invention. The method 600 for constructing a dowel includes positioning a rod within a corrosion-resistant sleeve 610 and sealing the rod with respect to the corrosion-resistant sleeve 612. Sealing the rod with respect to the corrosion-resistant sleeve includes placing a sealant on the outer surface of the rod. In some embodiments, the rod is substantially cylindrically shaped. Sealing the rod with respect to the corrosion-resistant sleeve 612 includes placing a sealant on the cylindrical surface of the rod. The method further includes rotating the rod 614. In some embodiments, the rod is rotated as it is positioned within the sleeve. In other embodiments, the rod is rotated after it is positioned within the sleeve. Sealing the rod with respect to the corrosion-resistant sleeve, in some embodiments, includes placing a sealant over a first end of the rod and a second end of the rod 616.

Figure 7:
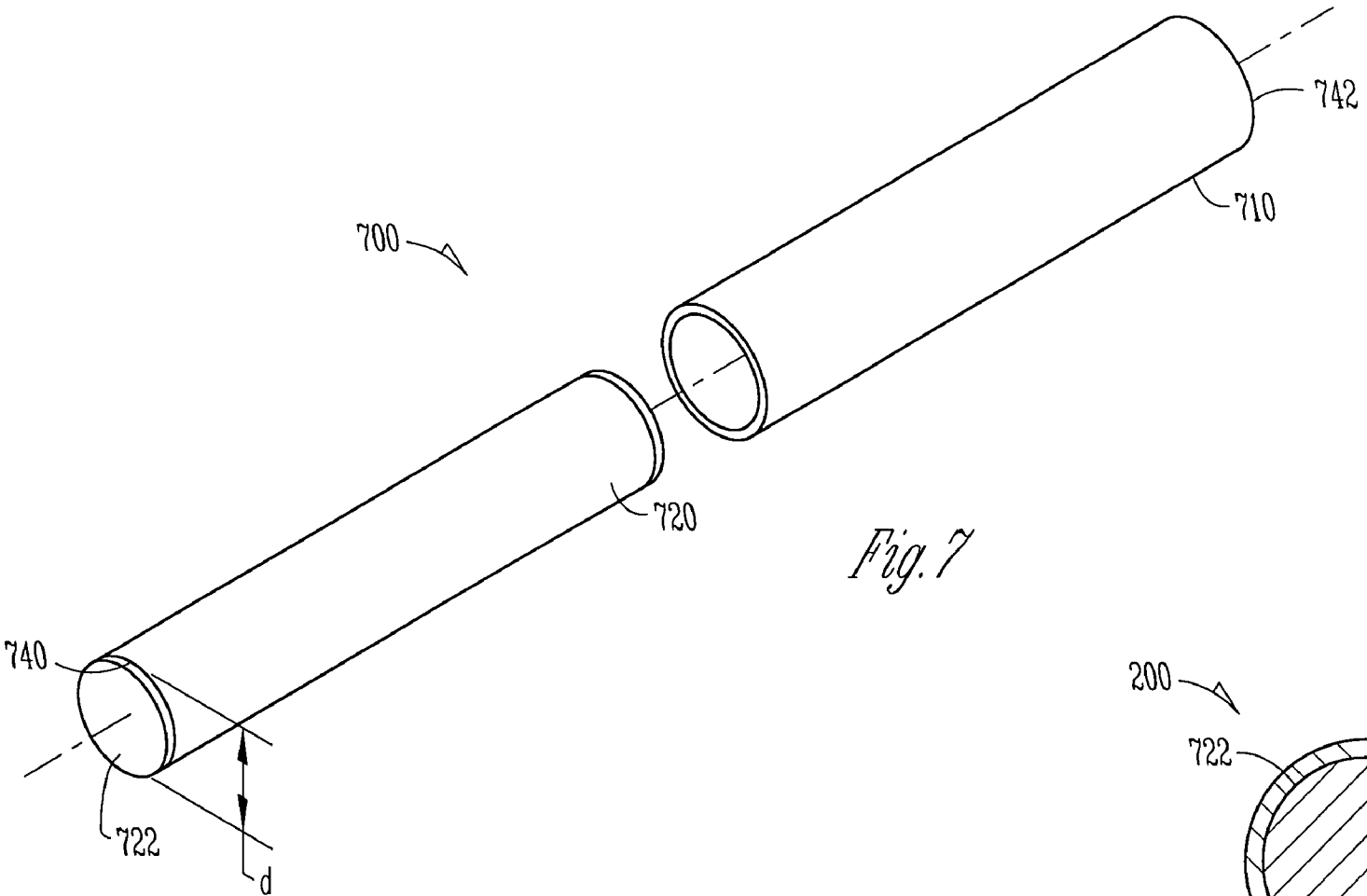
FIG. 7 is an exploded perspective view of dowel, according to an embodiment of this invention.

FIG. 7 is an exploded perspective view of dowel 700, according to an embodiment of this invention. The dowel 700 includes a corrosion-resistant or non-corrosive sleeve 710 and a rod 720 positioned within the corrosion-resistant sleeve 710. The rod 720 can also be termed a core. The rod or core 720 has a diameter that is slightly smaller than the inner diameter of the corrosion-resistant sleeve 710. The corrosion-resistant sleeve 710 can be made of any non-corrosive or corrosion-resistant material such as plastic, fiberglass or stainless steel. In one embodiment of the invention, the corrosion-resistant sleeve 710 is made of a grade 316L-A269 type of stainless steel as defined by the American Society for Testing and Materials (ASTM). In this embodiment, the rod or core 720 is coated with an epoxy coating 722. The epoxy coating 722 is formed by charging the rod or core 720 and coating the rod or core with an epoxy powder. Once coated with the powder, the powder covered rod or core 720 is heated. An appropriate amount of heat is applied to melt the powder and cause it to flow slightly. The epoxy can then be baked at another temperature. The resultant epoxy coating 722 covers the exterior surface of the rod or core 720. In another embodiment, the epoxy coating 722 covers the cylindrical portion of the rod or core 720. The epoxy coating 722 substantially seals the rod or core 720 and provides a barrier to water or other chemicals. Thus, the epoxy coating 722 inhibits or prevents introduction of materials to the rod or core 720 that would allow corrosion. The epoxy coating 722 also provides a barrier to the flow of electrons between the core or rod 720 and the sleeve 710 that prevents a galvanic reaction between the core 720 and the sleeve 710.

The rod or core 720 coated with epoxy 722 has a diameter (d) that is slightly larger than the inner diameter of the sleeve 710. As a result, when the rod or core 720 with the epoxy coating 722 is placed within the sleeve 710, a press fit is used. In some embodiments, a portion of the epoxy coating 722 is removed as the rod or core 720 is press fit into the sleeve 710. In other words, a portion of the epoxy coating 722 can be shaved off as a result of press fitting the core 720 into the sleeve 710. After press fitting the core or rod 720 into the sleeve 710, a sealant is used to seal the circular ends 740 and 742 of the assembled core 720 and sleeve 710. As a result, the core or rod 720 is sealed with respect to the sleeve 710 as well as with respect to the outside environment. The sealant also acts as an adhesive is used to further attach the rod or core 700 within the corrosion-resistant or non-corrosive sleeve 710.

Figure 8:
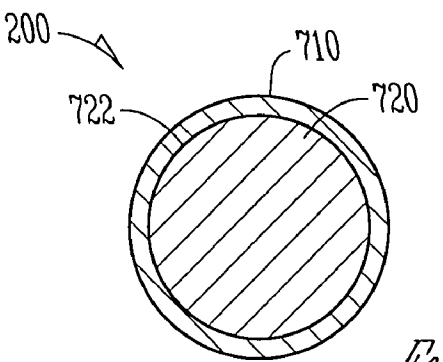
FIG. 8 is a cross-sectional view of the dowel of FIG. 7 after the rod or core has been press fit within the sleeve, according to an embodiment of this invention.

FIG. 8 is a cross-sectional view of the dowel of FIG. 7 after the rod or core 720 has been press fit within the sleeve 710, according to an embodiment of this invention. As shown in FIG. 8, the rod 720 of a first material is substantially sealed with respect to a sleeve of corrosion-resistant or non-corrosive sleeve 710 by a layer of epoxy coating 722. The epoxy coating 722 is substantially uniformly distributed about the periphery of the rod or core 720. The epoxy coated rod is press fit into the sleeve 710. As a result of the press fit, the core or rod 720 is securely held within the corrosion-resistant sleeve 710.

Figure 9:
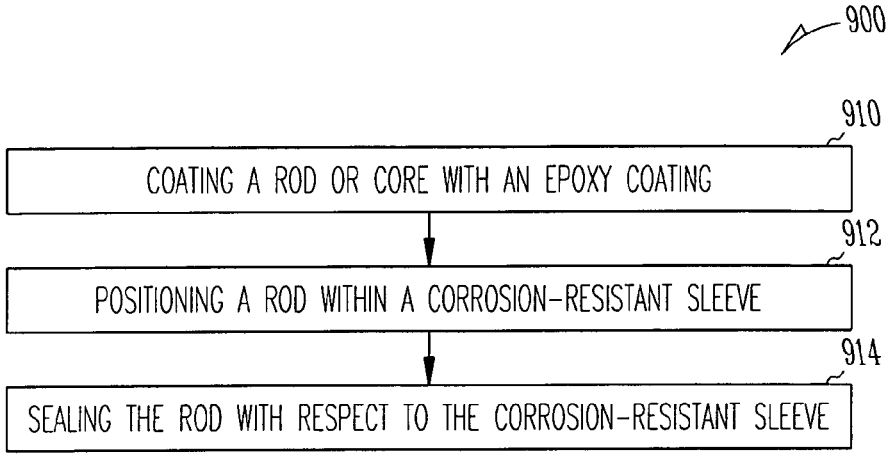
FIG. 9 is a flow diagram of a method of forming a dowel, according to an embodiment of this invention.

FIG. 9 is a flow diagram of a method 900 of forming a dowel, according to an embodiment of this invention. The method 900 for constructing a dowel includes coating a rod or core with an epoxy coating 910, positioning a rod within a corrosion-resistant sleeve 912, and sealing the rod with respect to the corrosion-resistant sleeve 914. Positioning a rod within a corrosion-resistant sleeve 912 includes press fitting the epoxy coated rod or core within the sleeve. Sealing the rod with respect to the corrosion-resistant sleeve includes placing a sealant on the outer surface of the rod. In some embodiments, the rod is substantially cylindrically shaped. Sealing the rod with respect to the corrosion-resistant sleeve, in some embodiments, includes placing a sealant over a first end of the rod and a second end of the rod or core.

It is to be understood that the phraseology or terminology employed herein is for the purpose of description and not of limitation. Accordingly, the invention is intended to embrace all such alternatives, modifications, equivalents and variations as fall within the spirit and broad scope of the appended claims.

Figure 10:
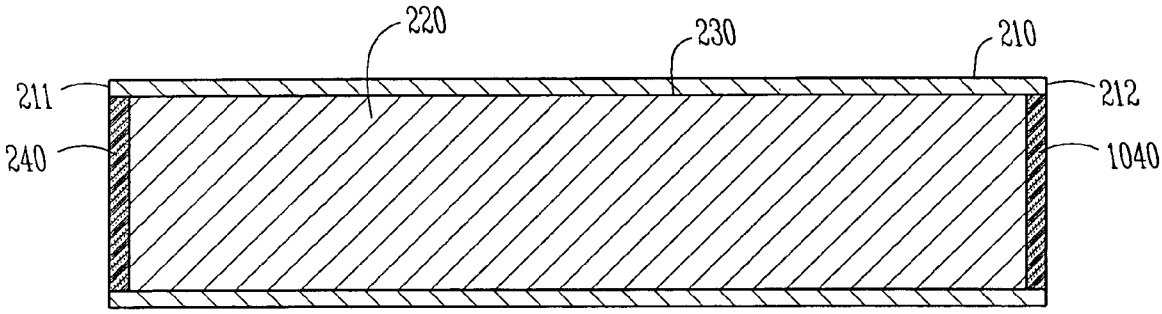
FIG. 10 is a cross-sectional view of the dowel along line 10-10 in FIG. 3, according to an embodiment of this invention.

FIG. 10 is a cross-sectional view of the dowel along line 10-10 in FIG. 3, according to an embodiment of this invention. The assembled dowel 200 has the core 220 extended or positioned within the inner diameter of the corrosion-resistant or non-corrosive sleeve 210. A sealant and adhesive material 230 substantially seals the core 220 from the corrosion-resistant sleeve 210. In addition to the adhesive and sealant material 230 on the cylindrical or cylindrical surface of the core or rod 220, an end cap 240 of a sealant or an adhesive and sealant material is placed over the end of the rod or core 220 to further seal the rod 220 within the corrosion-resistant or non-corrosive sleeve 210. The end cap 240 of the adhesive and sealant material is associated with the end 211 of the sleeve. A similar end cap 1040 of adhesive and sealant material is also formed at the other end 212 of the corrosion-resistant or non-corrosive sleeve 210 of the dowel 200. Therefore, each end 211 and 212 of the corrosion-resistant sleeve 210 includes an end cap, such as end cap 240 and end cap 1040, which substantially seals the ends of the rod or core 220. The end result is that the core or rod 220 is substantially sealed with respect to the corrosion-resistant or non-corrosive sleeve 210.

What is claimed is:

1. A dowel comprising:

a corrosion-resistant sleeve;

a rod positioned within the corrosion-resistant sleeve, the ends of the rod within the ends of the sleeve;

a sealant positioned between the outer cylindrical portion of the rod and the inner cylindrical surface portion of the corrosion-resistant sleeve wherein the rod is a steel rod that includes a first end and a second end, and wherein the corrosion-resistant sleeve includes a first end and a second end, wherein the sealant extends across and covers the first and second ends of the corrosion-resistant sleeve and the sealant extending across the first and second ends of the corrosion resistant sleeve cooperates with the corrosion resistant sleeve to envelop the entire rod and prevent exposure of the first end of the rod within the corrosion-resistant sleeve and the second end of the rod within the corrosion-resistant sleeve.

2. The dowel of claim 1 wherein the corrosion-resistant sleeve is a stainless steel sleeve.

3. The dowel of claim 1 wherein the rod positioned within the corrosion-resistant sleeve is a steel rod.

4. The dowel of claim 1 wherein the sealant connecting the corrosion-resistant sleeve and the rod.

5. The dowel of claim 1 wherein the sealant includes silicone.

6. The dowel of claim 1 wherein the sealant includes an adhesive.

7. The dowel of claim 1 wherein the dowel further comprises a coating on the rod, the coating substantially sealing the rod with respect to the corrosion-resistant sleeve.

8. The dowel of claim 7 wherein the coating on the rod includes an epoxy.

9. The dowel of claim 7 wherein the coating on the rod and the rod are press fit into the corrosion-resistant sleeve.

10. A dowel system comprising:

a dowel further including:

a corrosion-resistant sleeve;

a rod positioned within the sleeve, the rod having a first end, a second end, and a cylindrical surface;

a sealant for substantially sealing the first end, the second end, and the cylindrical surface of the rod within the corrosion-resistant sleeve;

wherein the rod is a steel rod, and wherein the corrosion-resistant sleeve includes a first end and a second end, wherein the sealant extends across and covers the first and second ends of the corrosion-resistant sleeve and the sealant extending across the first and second ends of the corrosion resistant sleeve cooperates with the corrosion resistant sleeve to envelop the entire rod and prevent exposure of the first end of the rod within the corrosion-resistant sleeve and the second end of the rod within the corrosion-resistant sleeve; and a spacer assembly associated with the dowel.

11. The dowel system of claim 10 wherein the sealant also bonds the rod within the corrosion-resistant sleeve.

12. The dowel system of claim 10 wherein the spacer assembly includes at least one spacer attached to the dowel.

13. The dowel system of claim 10 wherein the spacer assembly includes at least one spacer attached to the corrosion-resistant sleeve.

14. The dowel system of claim 10 wherein the spacer assembly is adapted to hold the dowel a selected distance from a surface.

15. The dowel system of claim 10 further comprising a plurality of dowels, the spacer assembly adapted to hold the plurality of dowels at a selected distance from a surface.

16. The dowel system of claim 10 wherein the sealant is a coating on the rod.

17. The dowel system of claim 10 wherein the sealant is an epoxy coating on the rod.

18. A roadway comprising:

a first slab of material;

a second slab of material; and at least one dowel having a first end engaged with a first slab of material and a second end engaged with a second slab of material, the at least one dowel further comprising:

a corrosion-resistant sleeve;

a rod positioned within the sleeve, the rod having a first end, a second end, and a cylindrical surface;

a sealant for substantially sealing the first end, the second end, and the cylindrical surface of the rod within the corrosion-resistant sleeve;

wherein the rod is a steel rod, and wherein the corrosion-resistant sleeve includes a first end and a second end, wherein the sealant extends across and covers the first and second ends of the corrosion-resistant sleeve and the sealant extending across the first and second ends of the corrosion resistant sleeve cooperates with the corrosion resistant sleeve to envelop the entire rod and prevent exposure of the first end of the rod within the corrosion-resistant sleeve and the second end of the rod within the corrosion-resistant sleeve.

19. The roadway of claim 18 further comprising a spacer assembly associated with the at least one dowel.

20. The roadway of claim 19 further comprising a base of crushed material, the first slab of material and the second slab of material positioned adjacent the base of crushed material, the spacer assembly associated with the at least one dowel for spacing the dowel a selected distance from the base of crushed material.

21. The roadway of claim 18 further wherein the first end of the dowel is engaged with the first slab and the second end of the dowel is engaged with the second slab.

22. The roadway of claim 18 wherein the first slab of material and the second slab of material includes cement.

23. The roadway of claim 22 wherein the first slab of material and the second slab of material further includes aggregate.

24. A method for constructing a dowel comprising:

positioning a rod within a corrosion-resistant sleeve; and sealing the rod with respect to the corrosion-resistant sleeve, wherein sealing the rod with respect to the corrosion-resistant sleeve includes placing a sealant on the cylindrical surface of the rod, and sealing the rod with respect to the corrosion resistant sleeve includes sealing the first end of the corrosion-resistant sleeve and the second end of the corrosion-resistant sleeve with the sealant and the sealant extends across and covers the first and second ends of the corrosion-resistant sleeve and the sealant extending across the first and second ends of the corrosion resistant sleeve cooperates with the corrosion resistant sleeve to envelop the entire rod and prevent exposure of the first end of the rod within the corrosion-resistant sleeve and the second end of the rod within the corrosion-resistant sleeve.

25. The method of claim 24 wherein sealing the rod with respect to the corrosion-resistant sleeve includes placing a sealant on the outer surface of the rod.

26. The method of claim 24 wherein the rod is substantially cylindrically shaped and wherein sealing the rod with respect to the corrosion-resistant sleeve includes placing a plurality of beads of sealant on the cylindrical surface of the rod.

27. The method of claim 26 wherein the rod is rotated.

28. The method of claim 27 wherein the rod is rotated while it is positioned within the corrosion-resistant sleeve.

29. The method of claim 27 wherein the rod is rotated after it is positioned within the corrosion-resistant sleeve.

30. The method of claim 24 wherein sealing the rod with respect to the corrosion-resistant sleeve includes placing a coating on the rod.

31. The method of claim 24 wherein positioning a rod within a corrosion-resistant sleeve the rod with respect to the corrosion-resistant sleeve includes press fitting a coated rod within the corrosion-resistant sleeve.

32. The method of claim 24 wherein the rod is rotated.

* * * * *

UNITED STATES PATENT AND TRADEMARK OFFICE

CERTIFICATE OF CORRECTION

PATENT NO. : 7,632,037 B2
APPLICATION NO. : 10/912521
DATED : December 15, 2009
INVENTOR(S) : Mark Brinkman It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 0 days.

Signed and Sealed this

Twenty-first Day of December, 2010

David J. Kappos

David J. Kappos
*Director of the United States Patent and Trademark Office*